US007262741B2

(12) United States Patent
Krupezevic et al.

(10) Patent No.: US 7,262,741 B2
(45) Date of Patent: Aug. 28, 2007

(54) ULTRA WIDEBAND ANTENNA

(75) Inventors: Dragan Krupezevic, Stuttgart (DE); Mohamed Ratni, Esslingen (DE)

(73) Assignee: Sony Deutschland GmbH, Koeln (DE)

( * ) Notice: Subject to any disclaimer, the term of this patent is extended or adjusted under 35 U.S.C. 154(b) by 18 days.

(21) Appl. No.: 11/291,406

(22) Filed: Dec. 1, 2005

(65) Prior Publication Data

US 2006/0119529 A1 Jun. 8, 2006

(30) Foreign Application Priority Data

Dec. 3, 2004 (EP) ..... 04028746

(51) Int. Cl.
*H01Q 13/10* (2006.01)
*H01Q 21/26* (2006.01)
*H01Q 9/38* (2006.01)

(52) U.S. Cl. ..... 343/770; 343/797; 343/830

(58) Field of Classification Search ..... 343/732, 343/769, 770, 793, 797, 830
See application file for complete search history.

(56) References Cited

U.S. PATENT DOCUMENTS

| | | | | |
|---|---|---|---|---|
| 6,590,545 | B2 * | 7/2003 | McCorkle | 343/830 |
| 2002/0122010 | A1 | 9/2002 | McCorkle | 343/830 |
| 2003/0090436 | A1 | 5/2003 | Schantz et al. | 343/742 |
| 2003/0214444 | A1 | 11/2003 | Asai et al. | 343/700 MS |
| 2004/0217912 | A1 | 11/2004 | Mohammadian | 343/795 |
| 2005/0146471 | A1 * | 7/2005 | Kwon et al. | 343/702 |

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

An ultra wideband antenna includes at least one radiator for transmitting and/or receiving an electromagnetic wave, the radiator having a planar elliptical shape for the whole UWB frequency band and one having at least one elliptical gap for omitting the transmission and reception of an electromagnetic wave at a predefined wavelength λ, whereby the length of the gap depends on the predefined wavelength λ.

17 Claims, 5 Drawing Sheets

1
2b
2a
3a
3b
4

1
2
3
4

1
2b
2a
3a
4
3b 1
3
2
4

1
2b
2a
3a
3b
4

1
2
3
4

1
2b
2a
3a
3b
4

1
2
3
4

1
2b
2a
3a
3b
4

1
2
3
4

1
2b
2a
4

1
2
3
4

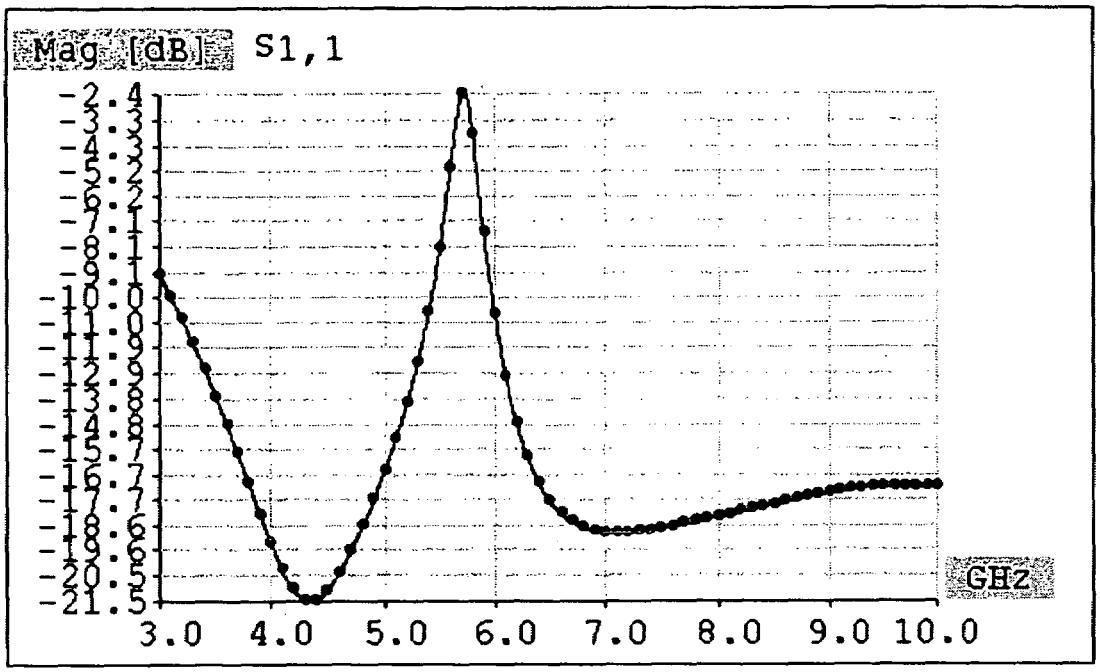
Fig.6: An example of an antenna matching
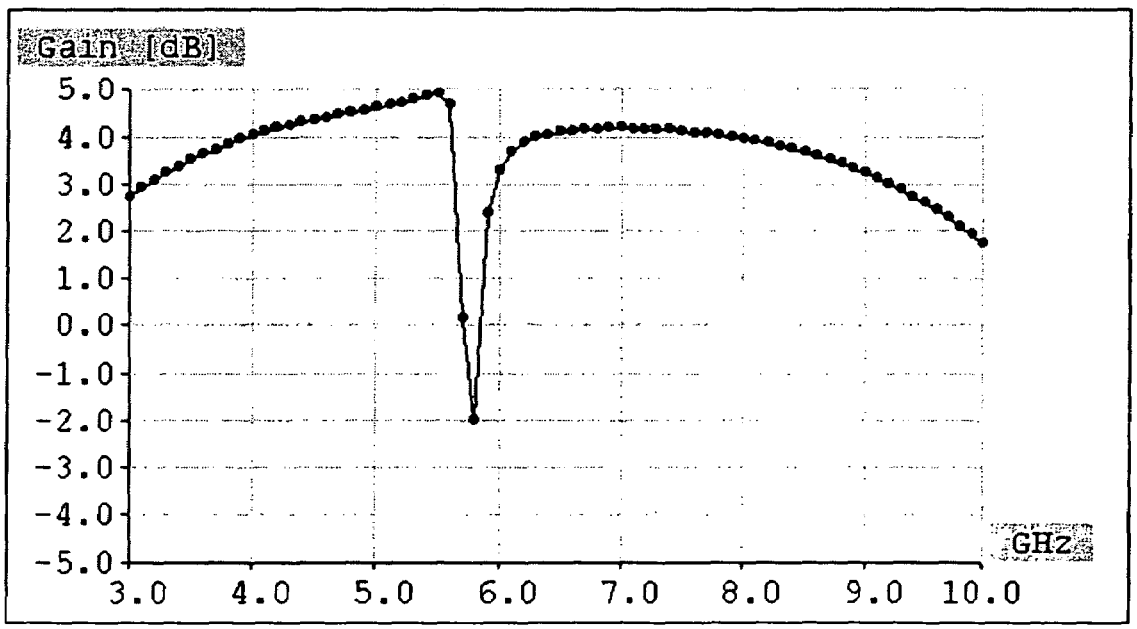
Fig.7: An example of an antenna Gain

ULTRA WIDEBAND ANTENNA

CROSS REFERENCE TO RELATED APPLICATIONS

This application is based upon and claims priority under 35 U.S.C. §119 from European Patent Application No. 04 028 746.8, filed Dec. 3, 2004.

BACKGROUND OF THE INVENTION

The present invention relates to an ultra wideband antenna.

In the recent past, the requirements for an antenna have significantly increased. There is the need to have antenna systems capable to address the ultra wide bandwidth (UWB) from approximately 3.1 to 10.6 GHz, which are more suited to amplify signals of interest while nullifying noise and signals from other areas. Further, it is preferred to have a radiation pattern with a small group delay, a high gain and an antenna with a small size, which, in addition, is cost-effective.

From the state of art ultra wideband antennas are known covering the whole frequency bandwidth from approximately 3.1 to 10.6 GHz. The problem that arises with an ultra wideband antenna is that the frequency bandwidth of the transmitted and received signals is very large in comparison with a conventional antenna used for multimedia wireless loop or any wireless communication system. Therefore it is very difficult to adapt the antenna and to have a flat gain in the whole frequency bandwidth. Moreover, the phase variation Vs frequency should be linear in the whole band and therefore minimise the group delay. The other problem which arises in UWB communication systems is the other wireless communication systems which operate in the same frequency band but occupy a very small bandwidth.

SUMMARY OF THE INVENTION

The object of the present invention is therefore to provide an ultra wideband antenna that can easily be adapted to tough requirements in terms of frequency bandwidth, gain flatness, phase linearity (group delay) . . . etc. The second object of the present invention is to provide an ultra wideband antenna which is able to avoid conflicts with existing wireless systems operating in the same frequency band.

This object is achieved by means of the features of the independent claim.

According to the present invention, an ultra wideband antenna is proposed comprising at least one radiator for transmitting and/or receiving an electromagnetic wave, said radiator being of an elliptical shape. Different structures have been designed in order to achieve UWB performances.

On the other hand, these structures can also be designed in the same shape but having at least one elliptical gap for suppressing or omitting the transmission and reception of an electromagnetic wave at a predefined wavelength $\lambda$ (notch frequency), whereby the length of the elliptical gap depends on said predefined wavelength $\lambda$ (notch frequency).

By using an ultra wideband antenna having at least one elliptical gap for suppressing the transmission and reception of a predefined wavelength, the antenna can easily be adapted to various frequency bands thereby providing the possibility of suppressing unwanted wavelength bands.

Advantageously, the length l of the elliptical gap is approximately a quarter of said predefined wavelength $\lambda$, i.e. $l=\lambda/4$, where l is equal to the half of the elliptical perimeter and where $\lambda$ is said predefined wavelength.

Advantageously, the center of the radiator is not coincident with the center of the elliptical gap, whereby the radiator is located eccentrically from the elliptical gap.

In a preferred embodiment the antenna comprises a feeding circuit for transferring signal energy to and/or from the radiator.

Preferably, the center of the elliptical gap is located on a straight line extending from the center of the radiator to the feeding circuit.

The antenna can consist of a single radiator.

The antenna can consist of two radiators being located orthogonally to each other.

Advantageously, the radiator comprises one elliptical gap.

The radiator can comprise two elliptical gaps.

Preferably, the elliptical gaps are located concentrically having the same center.

The antenna can be a ground plane antenna.

The antenna can be a dipole antenna.

BRIEF DESCRIPTION OF THE DRAWINGS

In the following description, preferred embodiments of the present invention are explained in more detail in relation to the enclosed drawings in which FIG. 6 shows an example of the matching of an antenna according to the present invention and FIG. 7 shows an example of the gain of an antenna according to the present invention.

DETAILED DESCRIPTION OF THE INVENTION

In the following, an antenna 1 (FIG. 3*h*) according to the present invention is described comprising at least one radiator 2 for transmitting and/or receiving an electromagnetic wave. The antenna 1 comprises a feeding line 4 for transferring signal energy to and/or from the radiator 2. Further, the radiator 2 has at least one elliptical gap 3 for surpressing or omitting the transmission and/or reception of the electromagnetic wave (frequency notch) at a predefined wavelength.

Figure 1:
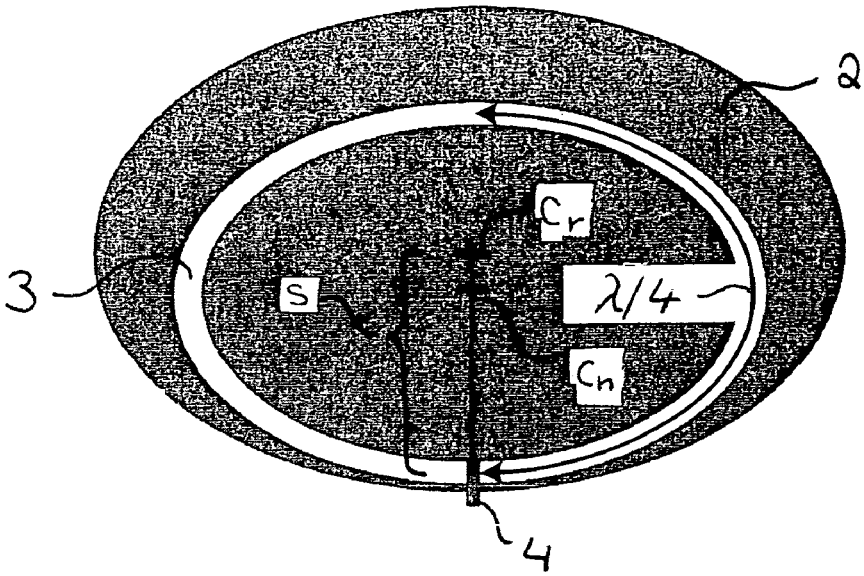
FIG. 1 shows a schematic view of an antenna according to the present invention.

It is to be noted that the present antenna may also comprise further features necessary for the functionality of an antenna, e.g. a power supply or the like, which are not explained in the following and not shown in the figures for the sake of clarity. FIG. 1 shows a schematic view of an antenna 1 according to the present invention.

The radiator 2 for transmitting and/or receiving an electromagnetic wave is planar having an elliptical shape. The radiator 2 can be made using any conductive material such as copper or aluminium. It is also possible to use plastic or other material for that purpose and to cover the structure of the walls with a thin metallization print thereby providing an antenna easy to manufacture.

The antenna structure presents no dielectric radome, but it is also possible to use a dielectric radome for mechanical stability. The antenna according to the present invention provides a linear vertical polarisation.

The radiator 2 comprises at least one elliptical gap 3, i. e. a gap or an opening in the radiator 2 in order to block the transmission and/or reception of a predefined wavelength. By implementing the elliptical gap 3 into the radiator 2 the antenna 1 does not transmit and/or receive electromagnetic waves at a predefined wavelength.

The gap or an opening 3 in the radiator 2 hereby also has an elliptical shape.

The length of the elliptical gap 3 is adapted to the wavelength, which has to be omitted or supressed. The length of the elliptical gap 3 is approximately one quarter of the suppressed wavelength. With the length of the elliptical gap the half length of the elliptical perimeter is meant.

By adding (one or more) additional gaps or openings (elliptical gap) with different lengths a wider band of wavelengths can be omitted.

In order to properly explain the shape and relative location of the radiator 2 and the elliptical gap 3 according to the present antenna 1, in the following the principle of an ellipse will be explained with reference to FIG. 2.

Figure 2:
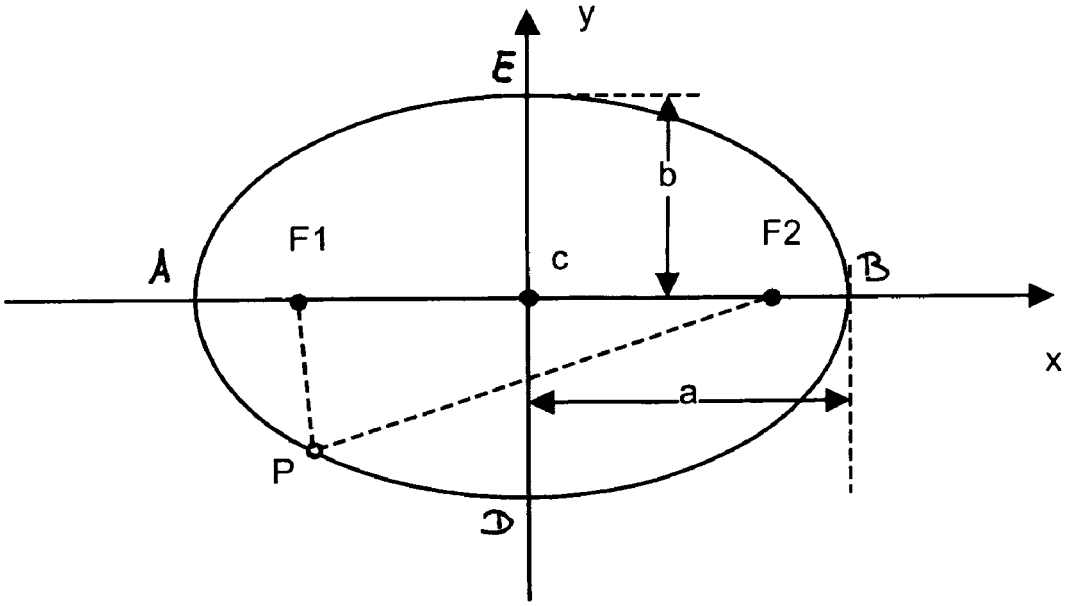
FIG. 2 shows a schematic view of an ellipse.

FIG. 2 shows a general view of an ellipse. An ellipse in geometry is defined as the set of all points P, which have the same constant sum 2*a* of distances from two given fixed points called foci $F_1$ and $F_2$. This can be expressed by the following condition:

$$\text{ell}=\{P|\overline{PF_1}+\overline{PF_2}=2a\} \tag{1}$$

The center c of the ellipse is the point lying in the middle of the two foci $F_1$ and $F_2$. The points A and B are the points lying farthest away from the center c, and the points D and E are the points lying nearest to the center c. The connection line between A and B going through the center c of the ellipse is the major axis, and the connection line between D and E going through the center of the ellipse is the minor axis. The major axis and the minor axis are orthogonal to each other and intersect in the center c of the ellipse.

The letter a hereby denotes the semi-major axis, i.e. the distance between the center c of the ellipse and the points A or B lying farthest away from the center c. The letter b denotes the semi-minor axis, i.e. the distance between the center c and the points D or E lying nearest to the center c. In a coordinate system having an x-axis and a y-axis, where the center c of the ellipse is coincident with the origin of the coordinate system and where the major axis is coincident with the x-axis, the ellipse can be expressed as follows:

$$\frac{x^2}{a^2}+\frac{y^2}{b^2}=1. \tag{2}$$

It is to be noted that a circle is a special case of an ellipse, as in a circle a=b=r, where r is the radius of the circle. Equation (2) then can be written as $$x^2+y^2=r^2 \tag{3}$$

The radiator 2 shown in FIG. 1 can have an elliptical shape as defined above. The term "elliptical shape" used in the present application could in a special case be a circular shape. Further, a feeding circuit 4 is provided in order to transfer signal energy to and/or from the radiator 2. The feeding circuit 4 is provided at the minor or major axis of the ellipse, i.e. at one of the points A, B, D or E. The feeding hereby can be realised using a coaxial cable or a micro-strip line, which means that there are no special mounting or complicated electronic requirements.

The radiator 2 according to the present invention, comprises at least one elliptical gap 3 for omitting the transmission and reception of a predefined wavelength λ. The gap 3 has an elliptical shape which includes also a circular shape. Hereby, the arc length of the elliptical gap 3 is in the range of quarter of the predefined wavelength λ. That means that if the transmission and reception of a special wavelength has to be omitted, then, the elliptical gap 3 can be adapted accordingly. The length 1 of the elliptical gap 3 has to fulfil the following relation:

$$l=\lambda/4 \text{ where } l \text{ is equal to the half of the elliptical perimeter.} \tag{4}$$

The relation between the length 1 of the elliptical gap 3 and the frequency f can be calculated by using the relation between the wavelength λ and the frequency f, which is:

$$\lambda=\frac{c}{f}, \tag{5}$$

where c is the velocity of light. Therewith equation 4 can be written in the form:

$$\frac{120}{f[\text{GHz}]}\le l[\text{mm}]\le\frac{180}{f[\text{GHz}]} \tag{6}$$

$$\frac{150}{f[\text{GHz}]}=l[\text{mm}] \tag{7}$$

Hereby, the length l of the elliptical gap 3 is measured in mm and the frequency f is measured in GHz.

If a wide band of frequencies has to be blocked, then multiple elliptical gaps 3 should be implemented. Each arc length defines a specific notch frequency.

As can be seen from the above equation (4), the wavelength and the length l of the elliptical gap 3 are proportional. This means that with an increasing length l of the elliptical gap 3 also the omitted wavelength increases and that with a decreasing length l of the elliptical gap 3 also the omitted wavelength decreases. As explained above, a wide band of wavelengths can be blocked with multiple elliptical gaps 3.

As already explained, one ore more elliptical gap 3 can be provided in a radiator 2. Hereby, either several single elliptical gaps 3 can be provided in order to block several single frequencies.

Hereby, the elliptical gaps 3 are all located concentrically, i.e. they have the same center $c_n$ and the same direction of the major and minor axis. Further, the gaps and the radiator 2 are located eccentrically, i.e. the radiator 2 has a center $c_r$ being at a different position than the center $c_n$ of the gaps 3. The center $c_n$ of the gaps 3 is lying on a straight line extending from the center $c_r$ of the radiator 2 to the feeding circuit 4. That means that the center $c_n$ of the gaps is lying either on the minor axis or on the major axis of the elliptical radiator 2.

As already mentioned, the antenna 1 according to the present invention can consist of a single or of two radiators 2. In case the antenna 1 consists of two radiators 2, then the radiators 2 have the same center $c_r$, are located orthogonal to each other and intersect either in the semi-major or the semi-minor axis. The cross orthogonal radiators 2 can either be a combination of two or more pieces or can be manufactured as a single piece.

With reference to FIGS. 3*a* to 3*l* in the following preferred embodiments of the present antenna will be explained in detail.

Figures 3A, 3B, 3C, 3D, 3E, 3F:
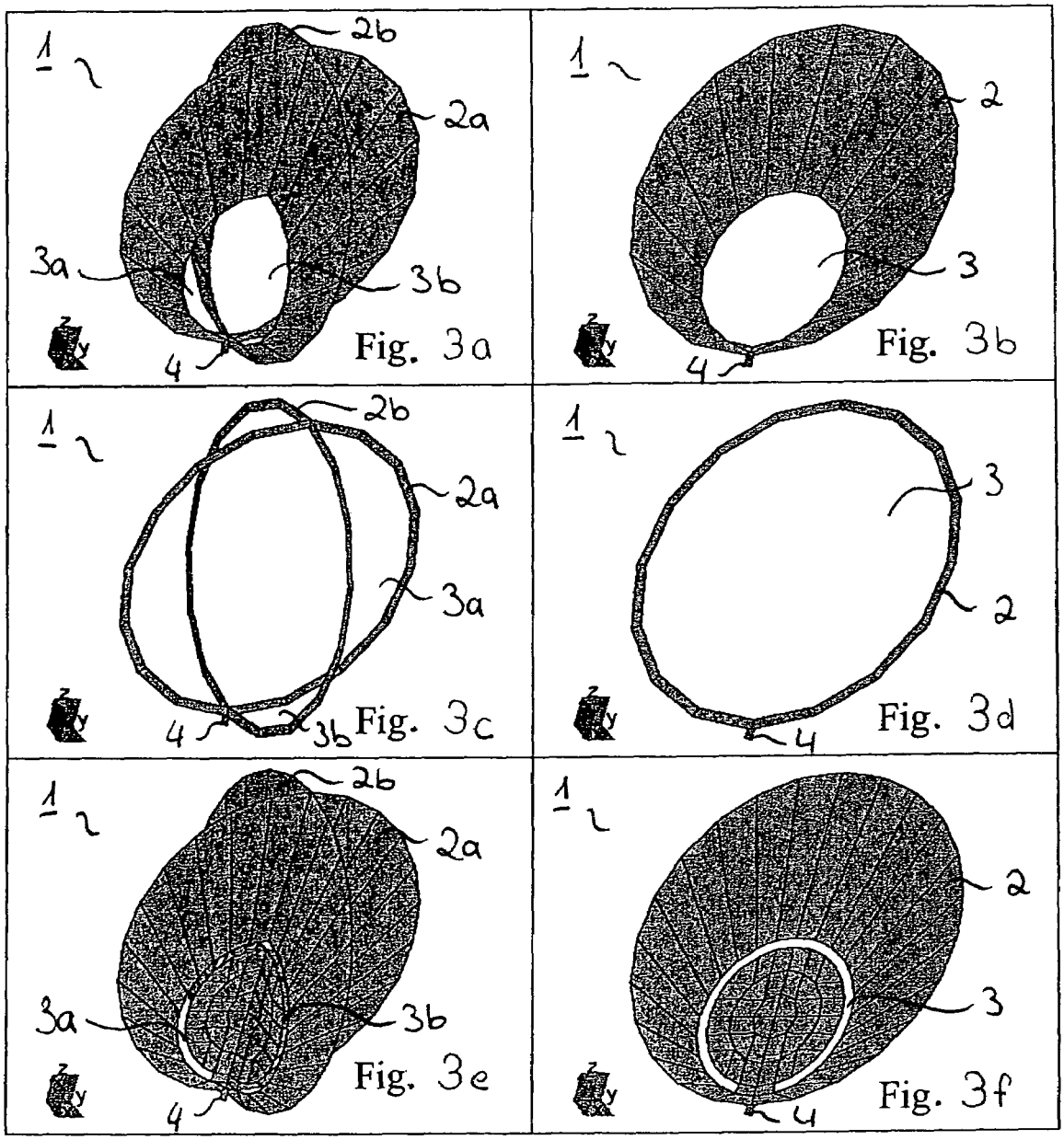
FIGS. 3*a* to 3*d* show schematic views of different embodiments of an UWB antenna according to the present invention.
FIGS. 3*e* to 3*l* show schematic views of different embodiments of an UWB antenna with notch function according to the present invention.

FIGS. 3*b*, 3*d*, 3*f*, 3*h* and 3*j* show antennas 1 consisting of a single radiator 2. Hereby, the antennas of FIGS. 3*b*, 3*f*, 3*h* and 3*j* are vertical elliptic disc antennas and the antenna of FIG. 3*d* is a vertical elliptic ring antenna. In contrast hereto FIGS. 3*a*, 3*c*, 3*e*, 3*g*, 3*i*, 3*k* and 3*l* show cross orthogonal antennas 1 consisting of two radiators 2 intersecting each other and being orthogonal to each other as explained above. Hereby, the antennas of FIGS. 3*a*, 3*e*, 3*g*, 3*i*, 3*k* and 3*l* are vertical cross orthogonal elliptical disc antennas and the antenna of FIG. 3*c* is an vertical cross orthogonal elliptical ring antenna. Hereby, except the antennas shown in FIGS. 3*k* and 3*l*, all the cross orthogonal antennas 1 have radiators 2 being identical in size, shape and implemented gaps. As can be seen from FIG. 3*k*, the radiators 2 of a cross orthogonal antenna can have the same size but different gaps 3. In addition, according to FIG. 3*l*, the radiators 2 may also differ in size. FIGS. 3*a*, 3*b*, 3*c* and 3*d* show antennas 1 consisting of single radiator and cross orthogonal radiator. These antennas are designed without elliptical gap and considered to work in the whole UWB frequency band, therefore no notch frequency.

In one embodiment of the present invention the radiator 2 comprises a single elliptical gap 3 for omitting a single frequency or a narrow band of frequencies as can be seen in FIGS. 3*e* and 3*f*.

In FIG. 3*e* the two radiators 2*a*, 2*b* of the cross orthogonal antenna each comprise a single elliptical gap 3*a*, 3*b* and constitute a vertical cross orthogonal elliptical disc antenna with offset concentric ellipses as gaps, and in FIG. 3*f* the single radiator 2 comprises a single gap 3 and constitutes a vertical elliptical disc with an offset concentric ellipse as gap.

Figures 3G, 3H, 3I, 3J, 3K, 3L:
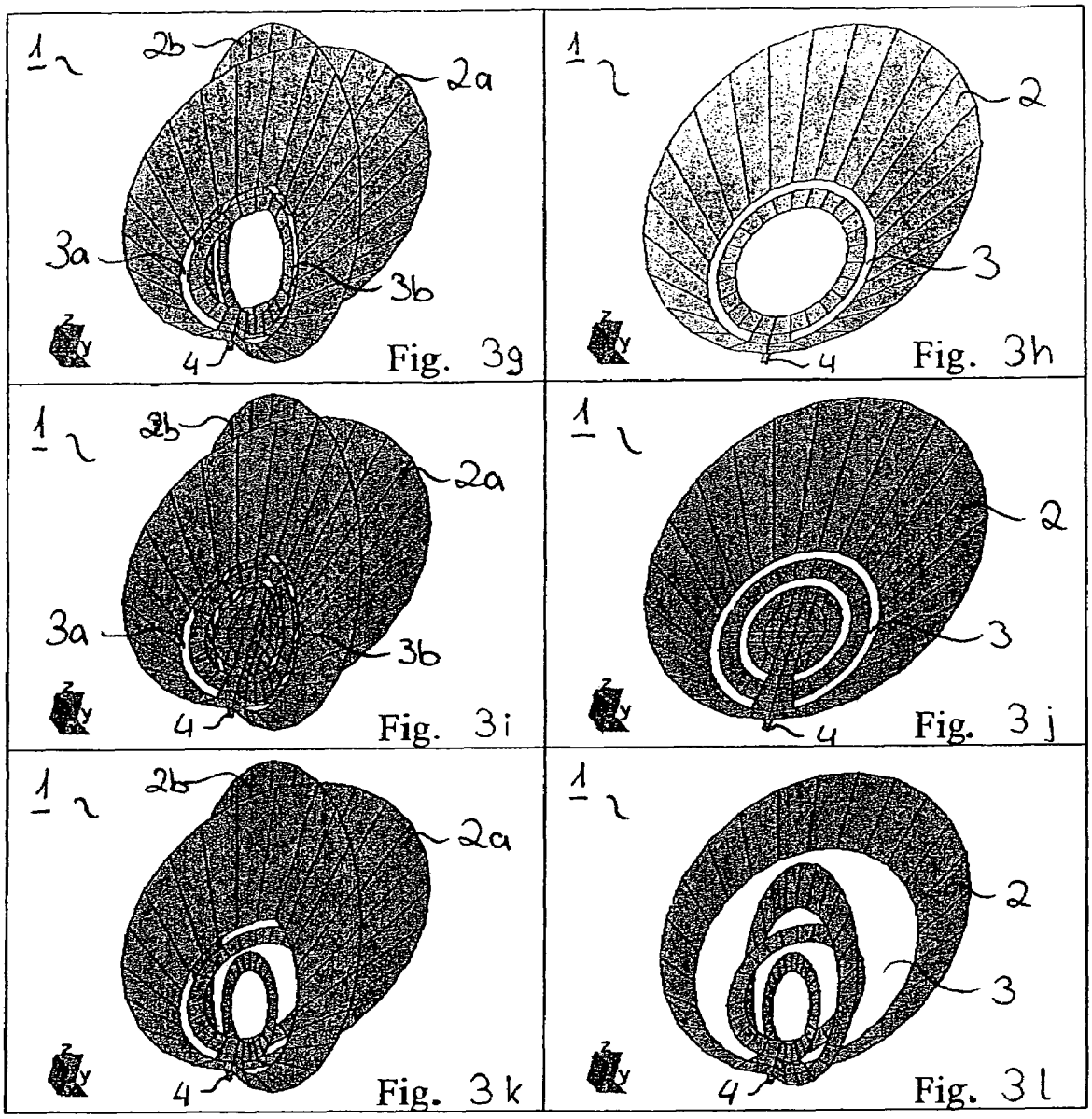

In FIG. 3*g* the two radiators 2*a*, 2*b* of the cross orthogonal antenna each comprise a single elliptical gap 3*a*, 3*b* and constitute a vertical cross orthogonal elliptical disc antenna with offset concentric ellipses as gaps and cross orthogonal elliptical ring. In FIG. 3*h* the single radiator 2 comprises a single gap 3 and constitutes a vertical elliptical disc with an offset concentric ellipse as gap and elliptical ring. FIG. 3*i* shows an antenna 1 consisting of two radiators 2*a*, 2*b* each radiator having two elliptical gaps 3 in order to omit two single frequencies or band frequencies. In an analogous way, FIG. 3*j* shows an antenna 1 consisting of a single radiator 2 having two elliptical gaps 3 thereby omitting the transmission and/or reception of two single frequencies or frequency bands. Hereby, the antenna of FIG. 3*i* is a vertical cross orthogonal elliptic disc antenna with two offset concentric rings as gaps, and the antenna of FIG. 3*j* is a vertical elliptical disc antenna with two offset concentric rings as gaps.

FIG. 3*k* shows a further embodiment of an antenna according to the present invention. Hereby, the antenna 1 consists of two radiators 2*a*, 2*b* having the same size but different gaps. The first radiator 2*a* comprises an elliptical gap provided as an elliptical offset and a further elliptical gap provided as a narrow elliptical ring. The second radiator 2*b* comprises an elliptical gap provided as an elliptical offset and a further gap provided as a larger elliptical ring. Further, the gaps of the radiators differ in size and arc length. Hereby, the antenna of FIG. 3*k* is a vertical crossorthogonal elliptic disc antenna with two offset orthogonal rings as elliptical gaps.

FIG. 3*l* shows another embodiment of an antenna according to the present invention consisting of two radiators being different in size and having different elliptical gaps. Each of the radiators has a gap provided as an elliptical offset and a further gap provided as a large elliptical ring, whereby all the gaps differ in size and arc length. Hereby, the antenna of FIG. 3*l* is a vertical cross orthogonal elliptical disc with two crossed offset concentric rings as elliptical gaps.

The antenna 1 (FIG. 3*a* to 3*d*) according to the principle of the present invention is able to cover the whole frequency bandwidth from 3.1 to 10.6 GHz. The antenna 1 (FIG. 3*e* to 3*l*) covers the whole frequency band from 3.1 to 10.6 GHz and at the same time is able to for example suppress the very congested frequency at 5 GHz or other frequencies in order to avoid other communication systems using that frequency band.

Figure 4A:
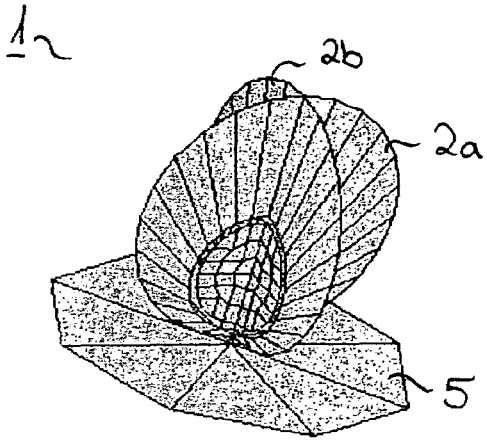
FIGS. 4*a* and 4*b* show one example of different implementations of the antenna according to the present invention.
Figure 4B:
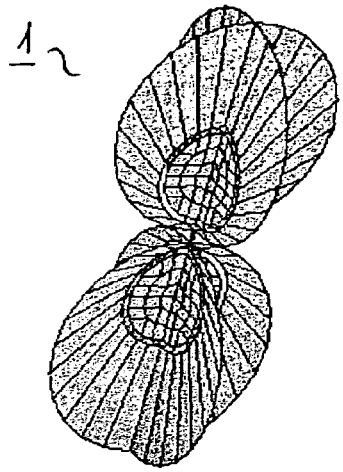

All the antennas according to the principle of the present invention can either be provided as a ground plane antenna or as a dipole antenna. FIG. 4*a* shows a ground plane antenna 1 consisting of two radiators 2*a* and 2*b* having a ground plate 5. Instead of two radiators also a single vertical radiator 2*a* can be used. FIG. 4*b* shows a dipole antenna consisting of four radiators, whereby respectively two radiators are implemented as a cross orthogonal elliptical antenna. In an analogous way, also two vertical antennas 2 each having a single vertical radiator 2 can be used as a dipole antenna.

Figure 5:
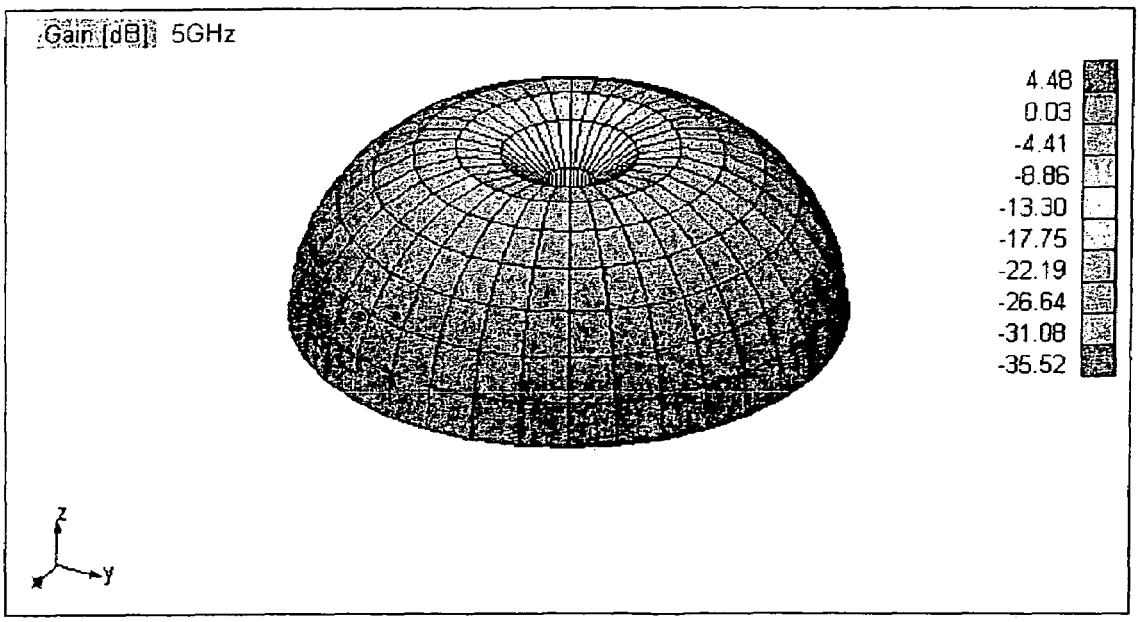
FIG. 5 shows the radiation pattern of an antenna according to the present invention.

FIG. 5 shows the radiation pattern of an antenna according to the principle of the present invention at the frequency of 5 GHz. The antenna structure presents a symmetrical omni-directional radiation pattern in azimuth plane over the whole frequency bandwidth. Further, the antenna structure presents a symmetrical omni-directional radiation pattern with 90 degree in elevation over the whole frequency bandwidth.

FIG. 6 shows the matching of an antenna according to the principle of the present invention having a notch at the frequency of 5.8 GHz, and FIG. 7 shows the gain of an antenna according to the principle of the present invention having a notch at the frequency of 5.8 GHz. The antenna presents a linear phase variation versus frequency outside the notch frequency, which results in a constant group delay over the whole frequency bandwidth. In addition, the antenna presents a typical VSWR<2 outside the notch frequency. This matching is obtained using resistive load.

The present antenna can be implemented in small consumer products, such as mobile terminals or the like.

The invention claimed is:

1. An ultra wideband antenna, comprising:

at least one radiator for transmitting and/or receiving an electromagnetic wave, said radiator having a planar elliptical shape, wherein the antenna covers a whole UWB frequency band, and the radiator includes at least two elliptical gaps located concentrically and having a same center.

2. The antenna according to claim 1, wherein the antenna includes a single radiator.

3. The antenna according to claim 1, wherein the antenna includes two radiators located orthogonal to each other.

4. The antenna according to claim 1, wherein the antenna is a ground plane antenna.

5. The antenna according to claim 1, wherein the antenna is a dipole antenna.

6. A mobile or fixed terminal comprising an ultra wideband antenna according to claim 1.

7. An ultra wideband antenna, comprising: at least one radiator for transmitting and/or receiving an electromagnetic wave, said radiator having a planar elliptical shape and having at least two elliptical gaps for suppressing the transmission and reception of an electromagnetic wave at a predefined wavelength λ, wherein the length of each gap depends on said predefined wavelength λ, and the at least two elliptical gaps are located concentrically and have a same center.

8. The antenna according to claim 7, wherein the length of each gap is in the range of a quarter of said predefined wavelength λ.

9. The antenna according to claim 7, wherein a center of the radiator is not coincident with the center of the elliptical gaps such that the radiator is located eccentrically from the gaps.

10. The antenna according to claim 7, wherein the antenna includes a feeding circuit for transferring signal energy to and/or from the radiator.

11. The antenna according to claim 10, wherein the center of each elliptical gap is located on a straight line(s) extending from the center of the radiator to the feeding circuit.

12. An ultra wideband antenna, comprising:

at least one radiator configured to transmit or receive an electromagnetic wave, said radiator having a planar elliptical shape, wherein the antenna covers a whole UWB frequency band, and the radiator includes at least two elliptical gaps located concentrically and having a same center.

13. The antenna according to claim 12, wherein the antenna includes a single radiator.

14. The antenna according to claim 12, wherein the antenna includes two radiators located orthogonal to each other.

15. The antenna according to claim 12, wherein the antenna is a ground plane antenna.

16. The antenna according to claim 12, wherein the antenna is a dipole antenna.

17. A mobile or fixed terminal comprising an ultra wideband antenna according to claim 12.

* * * * *